US006450213B1

(12) United States Patent
Gauthier et al.

(10) Patent No.: US 6,450,213 B1
(45) Date of Patent: Sep. 17, 2002

(54) SYMMETRICAL-WEAVE JUNCTION FOR A STRIP WOVEN WITH AN ASYMMETRICAL WEAVE

(75) Inventors: Maurice Gauthier, Hiersac; Jean-Louis Monnerie, Saint Junien, both of (FR)

(73) Assignee: COFPA - Compagnie des Feutres pour Papeteries et des Tissus Industriels, Gond Pontouvre (FR)

( * ) Notice: Subject to any disclaimer, the term of this patent is extended or adjusted under 35 U.S.C. 154(b) by 0 days.

(21) Appl. No.: 09/913,627

(22) PCT Filed: Feb. 14, 2000

(86) PCT No.: PCT/FR00/00359

§ 371 (c)(1),
(2), (4) Date: Aug. 16, 2001

(87) PCT Pub. No.: WO00/49223

PCT Pub. Date: Aug. 24, 2000

(30) Foreign Application Priority Data

Feb. 16, 1999 (FR) ..... 99 01864

(51) Int. Cl.[7] ..... D21F 1/00; D03D 3/04

(52) U.S. Cl. ..... 139/383 AA

(58) Field of Search ..... 139/383 AA

(56) References Cited

U.S. PATENT DOCUMENTS

| | | | | | |
|---|---|---|---|---|---|
| 4,438,789 | A | * | 3/1984 | MacBean | 139/383 AA |
| 5,458,161 | A | * | 10/1995 | Scarfe | 139/383 AA |
| 5,769,131 | A | * | 6/1998 | Whitlock et al. | 139/383 AA |
| 6,079,454 | A | * | 6/2000 | Lee et al. | 139/383 AA |

FOREIGN PATENT DOCUMENTS

| | | | |
|---|---|---|---|
| EP | 0 612 882 | * | 8/1984 |
| FR | 2 578 869 | * | 3/1985 |

* cited by examiner

*Primary Examiner*—Andy Falik
(74) *Attorney, Agent, or Firm*—Frommer Lawrence & Haug LLP; Ronald R. Santucci

(57) ABSTRACT

A woven strip comprising an asymmetrical weave of weft and warp yarns having symmetrical re-weaving zones extending from opposite ends thereof, in which the end warp yarns form a loop to accommodate a restraining rod. The woven strips provide fabrics for use in paper making machines and have the advantage of avoiding excess pressure during operation of the machine thereby reducing marking of the paper and wearing of the strips.

7 Claims, 2 Drawing Sheets

SYMMETRICAL-WEAVE JUNCTION FOR A STRIP WOVEN WITH AN ASYMMETRICAL WEAVE

CROSS REFERENCES TO RELATED APPLICATIONS NOT APPLICABLE

STATEMENT REGARDING FEDERALLY SPONSORER RESEARCH OR DEVELOPMENT NOT APPLICABLE

STATEMENT REGARDING FEDERALLY SPONSORED RESEARCH OR DEVELOPMENT NOT APPLICABLE

BACKGROUND OF THE INVENTION

1. Field of the Invention

The invention relates to a woven strip, for use in particular in the papermaking industry, the strip having an asymmetrical weave constituted by weft yarns and warp yarns extending between two opposite ends of the strip, the warp yarns being folded back at each end of the strip and re-woven with weft yarns over a re-weaving zone adjacent to said end so as to form loops.

For example, in the papermaking industry, machines for manufacturing paper continuously generally comprise three sections, respectively a forming section, a press section for extracting water, and a drier section for drying the sheet of paper.

In the drier section of a papermaking machine, the sheet of paper is applied to a set of heated cylinders. To improve the speed with which the sheet of paper dries, it is transported onto the heated cylinders by woven strips (sometimes referred to as drier wires), preferably having an asymmetrical weave, generally comprising round-section weft yarns woven with warp yarns of flat section, the warp yarns defining large floats on the front face of the strip which comes into contact with the sheet of paper. This type of strip serves to reduce the extent to which the sheet of paper is marked by the warp yarns, in a machine configuration in which the strip is constantly in contact with the sheet throughout its sinuous path over two horizontal rows of cylinders.

Furthermore, in a woven strip having an asymmetrical weave constituted by warp yarns defining floats on the front face of the strip, the neutral plane of the strip (the plane in which the strip is subject neither to compression nor to extension when the strip bends) lies between the midplane and the front face of the strip, in the thickness direction thereof. As a result the front face of the strip in contact with the sheet of paper travels at a speed that is substantially constant over the cylinders, thereby having the effect of reducing tension in the sheet of paper and thus reducing the risk of the strip being abraded once the dryness level of the sheet of paper becomes significant, in a machine configuration where the strip is constantly in contact with the sheet throughout the sinuous path of the sheet between the high and low cylinders of the machine.

Each woven strip is configured as an endless belt on being installed on the machine, e.g. by means of a rigid rod which is passed both through loops formed at one end of the strip and through loops firmed at the other end of the strip, with the loops of the two ends being meshed with one another prior to receiving the rod, as is well known. However, when this endless strip is put into operation, under the effect of the tensions acting on the strip while it is being driven, the junction line between the two ends of the strip as constituted by the rod is urged out from the midplane of the strip towards the front face of the strip, with the axis of the rod occupying a position on the neutral plane of the strip. This shift of the strip junction line in the thickness direction of the strip gives rise to excess pressure on the sheet of paper running a significant risk of marking the sheet of paper and of causing the strip to wear quickly. The object of the invention is to remedy those drawbacks.

2. Description of the Related Art Including Information Disclosure Under 37 CFR 1.97 and 1.98 Not Applicable

BRIEF SUMMARY OF THE INVENTION

To this end, the invention provides a woven strip having asymmetrical weave constituted by weft yarns and warp yarns extending between two opposite ends of the strip, the warp yarns being folded back at each end of the strip and re-woven with weft yarns over a re-weaving zone adjacent to said end so as to form loops, the strip being characterized in that each re-weaving zone is of symmetrical weave.

By means of such a structure, the junction line between the opposite ends of the strip is no longer subjected to displacement in the thickness direction of the strip when it is put under tension while configured as an endless belt. In the zones in which the warp yarn is re-woven, the neutral plane of the strip,coincides with its midplane which contains the junction line between the ends of the strip. Furthermore, the gradient of the neutral plane of the strip is spread over the two zones in which the warp yarn is re-woven and is no longer localized on the junction line between the two ends of the strip.

In a particular embodiment of the invention, each symmetrical-weave re-weaving zone adjacent to an end of the strip can be formed by causing the folded-back warp yarns at the ends to take the place of the adjacent warp yarns that have been interrupted prior to the re-weaving zone.

In a preferred embodiment of the strip of the invention, the warp yarns are folded orthogonally to the plane of the strip at each end thereof, and the weft yarns of the re-weaving zones are smaller in diameter than the weft yarns in the remainder of the strip.

By folding the warp yarns orthogonally to the plane of the strip, the size of the loops in the weft yarn direction is reduced. Nevertheless, after folding each warp yarn at one end of the strip is re-woven as extra thickness onto itself with the weft yarns in the re-weaving zone. However, the reduction in the diameter of the weft yarns in each re-weaving zone makes it possible to compensate for the extra thickness of the warp yarns so as to maintain thickness that is relatively constant for the strip over its entire length. Finally, crêping. the weft yarns during the operation of thermofixing the weft yarns and the warp yarns at high temperature makes it possible to reduce any difference in thickness between the re-weaving zones and the remainder of the strip.

In yet another preferred embodiment, the warp yarns re of flat section thus making it possible to reduce marking on the sheet of paper and to reduce the permeability of the strip.

BRIEF DESCRIPTION OF THE SEVERAL VIEWS OF THE DRAWING(S)

The invention is described in greater detail below with reference to particular embodiments given as non-limiting examples and shown in the accompanying drawings.

FIG. 1 is a highly diagrammatic longitudinal section view of the end of a woven strip 10 of the invention which is intended most particularly for a drier section in a papermaking machine.

DETAILED DESCRIPTION OF THE INVENTION

Figure 1:
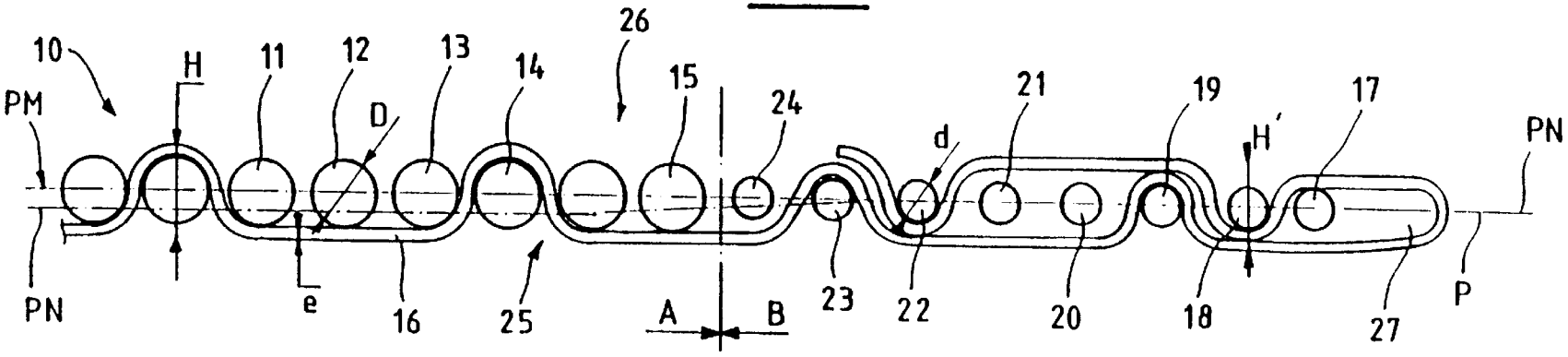
FIG. 1 is a highly diagrammatic longitudinal section showing one end of a woven strip of the invention having a single plane of weft yarns.

This woven strip comprises a single plane of weft yarns 11–15, 17–24 of round section, and warp yarns which in this case are flat in section and extend between the two opposite ends of the strip. Only one warp yarn 16 is shown in FIG. 1. On the front face 25 of the strip for coming into contact with the sheet of paper in the drier section of a papermaking machine, each warp yarn such as 16 defines large floats over the weft yarns, in this case floats covering three consecutive weft yarns, thus constituting an asymmetrical weave pattern in which the neutral plane PN of the strip is offset from the midplane PM of the strip. More particularly, it can be seen that after each float on the front face 25 of the strip, each warp yarn 16 passes through the weft plane to be woven over the back face 26 of the strip by going round a single weft yarn and passes back through the plane of the weft yarns to define another float on the front face of the strip. Naturally, adjacent warp yarns in the weft yarn direction cross through the weft plane at different positions along the strip, as is well known.

At each end of the strip, each warp yarn such as 16. is folded back and re-woven with the weft yarns 17–24 over a re-weaving zone in the vicinity of said end, but in such a manner that said re-weaving zone presents a weave that is symmetrical so that the neutral plane PN of the strip therein coincides with the midplane PM of the strip. More particularly, as can be seen in FIG. 1, the warp yarn 16 after being folded around the weft yarn 17 is re-woven as to define floats on the back face 26 of the strip covering three consecutive weft yarn such as 19–21. Consequently, after being folded back, each warp yarn is re-woven to occupy the back face of the strip using a weave that is symmetrical to the weave on the front face of the strip. The boundary of the re-weaving zone with a symmetrical weave for the warp yarns at one end of the strip is marked by arrow B, while arrow A marks the boundary of the remainder of the body of the strip in which the weave is asymmetrical.

As can be seen in FIG. 1, the warp yarn 16 of flat section is re-woven with weft yarns 17–24 in the re-weaving zone B that are of diameter d smaller than the diameter D of the weft yarns 11–15 in the remainder A of the strip, and the warp yarn 16 is re-woven so as to be superposed onto itself because it is folded back at the end of the strip in a manner that is orthogonal to the plane of the strip. During manufacture of the woven strip of the invention, weft yarns having a diameter D are replaced in each re-weaving zone at the end of the strip by means of weft yarns having a smaller diameter d so that after the warp yarns have been re-woven over the front and back faces of the strip, the thickness H' of the strip in the re-weaving zones B is the same as the thickness H of the main body A of the strip. For a woven strip having a single plane of weft yarns, the difference between the diameter of the weft yarns in the main body A of the strip and the diameter of the weft yarns in the re-weaving zones B is equal to twice the thickness of a flat section warp yarn such as 16. During the operation of re-weaving the warp yarns, the ends of these warp yarns are brought out through the back face 26 of the strip at different locations along the strip, depending on the weave pattern defined by the warp yarn in question, so as to have a bending gradient in the re-weaving zones.

In FIG. 1, it can be seen that the gradient of the neutral plane PN of the strip is distributed over a certain length of the strip where the re-weaving zone B and the main body A of the strip join.

Figure 2:
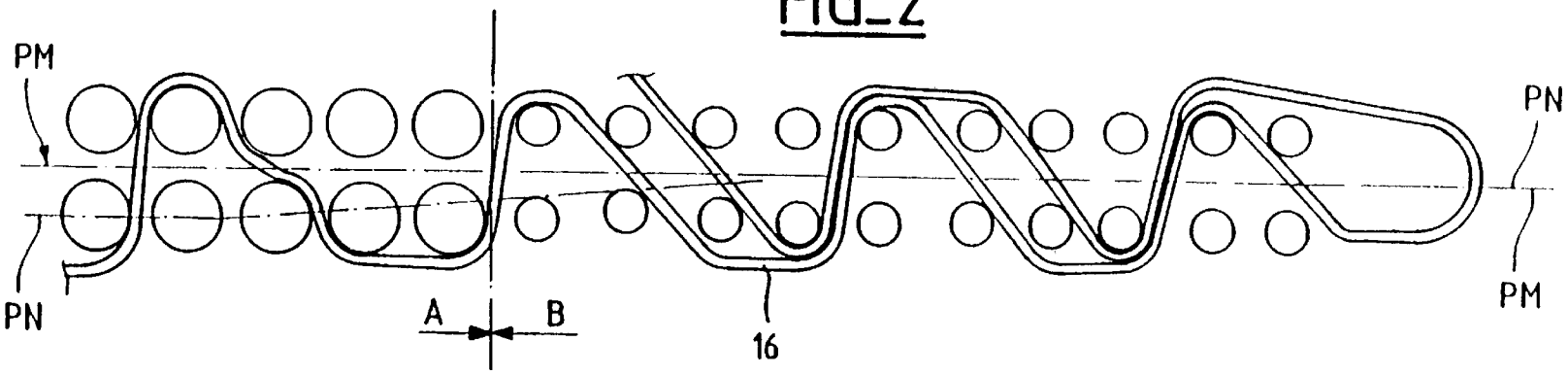
FIG. 2 is a highly diagrammatic longitudinal section showing one end of a woven strip of the invention having two planes of weft yarns.

FIG. 2 shows a woven strip analogous to that of FIG. 1, but having two planes of weft yarns. This figure shows the asymmetrical weave in the main body A of the strip and the symmetrical weave in the re-weaving zone B for warp yarns such as 16, and it also shows the disposition of the neutral plane PN of the strip relative to the midplane PM of the strip.

As mentioned above, each flat section warp yarn such as 16 is folded back at each end of the strip orthogonally to the plane of the strip to form either a junction loop such as 27, or else no junction loop, i.e. it passes tightly round the last weft yarn 17 at the end of the strip so as to leave an empty gap between two adjacent junction loops formed at said end of the strip. This reduction in the density of loops contributes to making it easier to join the two ends of the strip.

Figure 3:
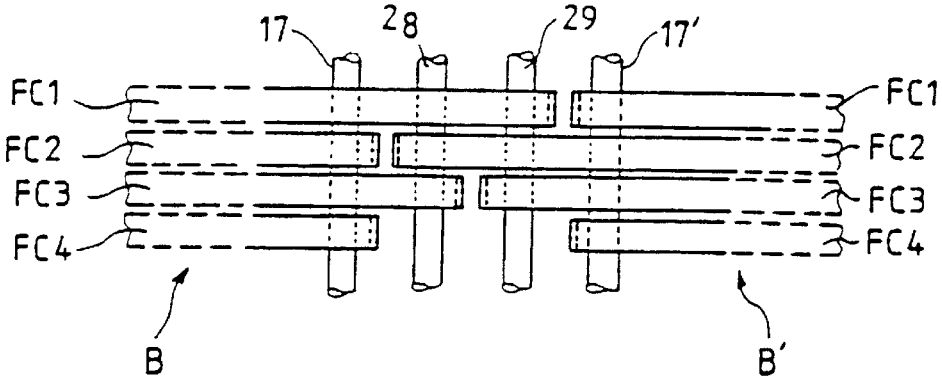
FIG. 3 is a highly diagrammatic plan view of the loops formed at the two ends of a woven strip of the invention for providing a junction by means of two rods.

FIG. 3 shows a first embodiment of junction loops at the two ends of a woven strip of the invention. This figure shows a sequence of four warp yarns FC1–FC4 at one end B of the strip (re-weaving zone B) forming respectively a large loop, no loop, a small loop, and no loop, and the same warp yarns FC1–FC4 at the opposite end B' of the strip (re-weaving zone B') forming respectively no loop, a large loop, a small loop, and no loop. At each end of the strip, the large loops project relative to the small loops. The loops at one end of the strip are meshed with the loops at the other end of the strip. The small loops at the end B of the strip co-operate with the large loops at the end B' of the strip to define a channel through which a first rod 28 is received. The large loops at the end B of the strip co-operate with the small loops at the end B' of the strip to define another is channel in which a second rod 29 is received. Under such circumstances, the strength of the junction zone is comparable to the strength of the remainder of the strip. The empty spaces left by the warp yarn FC4 at each end B. B' of the strip enable the loops formed by the warp yarns FC1, FC2, and FC3 to be less tight. This configuration of loops at each end of the strip makes it possible to reduce the permeability of the loop zone, to avoid marking the sheet of paper, and to obtain a junction of maximum strength while not increasing thickness relative to the remainder of the strip. Furthermore, the junction zone between the two ends of the strip can bend in the plane of the strip without pivoting about one of the rods 28 or 29. It should be observed that if the re-weaving is such that the loops formed at the two ends of the strip are all of identical length, then the loops could not mesh with one another because of their excessive density and it would not be possible to obtain a strong junction.

Figure 4:
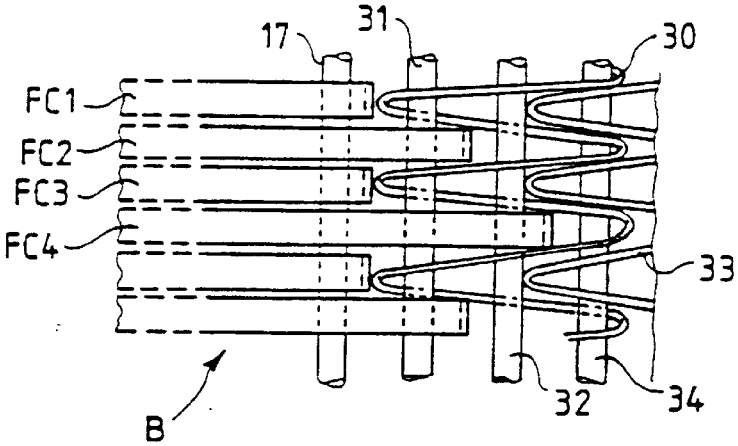
FIG. 4 is a highly diagrammatic plan view of the loops formed at one end of a woven strip of the invention for providing a junction by means of two spirals.

FIG. 4 shows a second embodiment of junction loops at the two ends of a woven strip of the invention for joining the two ends by means of two spirals. This figure shows a sequence of four warp yarns FC1–FC4 at one end B of the strip (re-weaving zone B) forming respectively: no loop, a small loop, no loop, and large loop. The turns of a first spiral 30 are meshed with the loops formed at said end of the strip and they are held by a first rod 31 received in a channel defined by the small loops and by the turns of the spiral. A second rod 32 is received in a channel defined by the large loops and by the turns of the spiral 30. This structure is identical on the other end of the strip (not shown). In particular, at the other end of the strip, the large and small loops of said end of the strip are meshed with the turns of a second spiral 33 held by a third rod received in a third channel formed by the small loops and by the turns, and by a fourth rod received in a fourth channel formed by the large loops and by the turns. The two spirals 30, 33 mounted in this way at each end of the strip are joined by a rod 34 secured to the meshed turns of the two spirals. The length of the loops formed at each end of the strip and the diameter of the rods 31 and 32 are designed in such a manner that after the two ends of the strip have been joined together and after the strip has been put under operating tension, the ends of the small loops bear against the rod 32 received in the large loops, thereby causing the small loops and the large loops to act together in providing tractive strength. The strength of the junction is then maximal and comparable to that of the configuration described with reference to FIG. 3. Furthermore, the large loops and the second rod 32 prevent the spiral 30 from pivoting about the first rod 31 and reduce the air permeability of the spiral zone, thereby contributing to reducing the risk of wear of the first rod 31 and the risk of the sheet of paper being marked. Each spiral is of a thickness identical to that of the strip and the width of the monofilament constituting each turn in the spirals must not exceed 80% of the width of a warp yarn.

Figure 5:
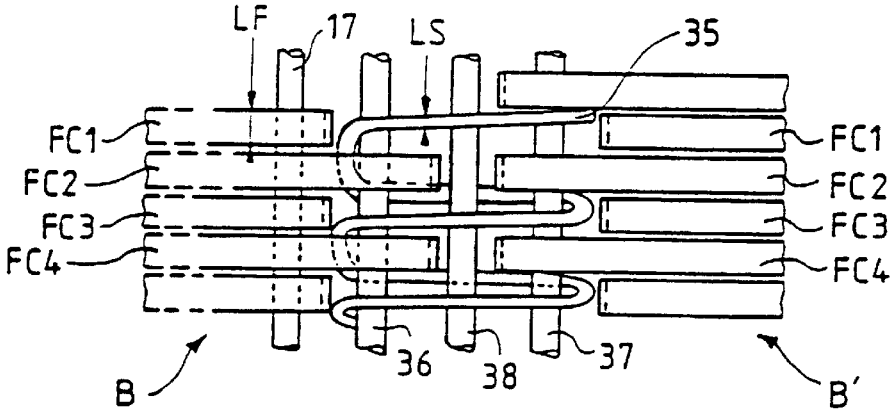
FIGS. 5 and 6 are highly diagrammatic plan views showing the loops formed at one end of a woven strip of the invention for providing a junction by means of one spiral.

FIG. 5 shows a third embodiment of junction loops formed solely at an end B' of a woven strip of the invention for joining together the two ends of the strip by means of a spiral 35. The spiral 35 is permanently fixed to the other end B of the strip during re-weaving at the end of strip manufacture by folding back warp yarns FC2 and FC4 around both the ends of the turns of the spiral and a rod 36. At the end B' of the strip shown in FIG. 5, loops are formed that are separated in pairs by empty spaces. In this figure it can be seen that the sequence of four warp yarns FC1–FC4 forming said end B' of the strip comprises respectively: no loop, a loop, no loop, and a loop. The turns of the spiral 35 are meshed with the loops and a rod 37 is received in the channel defined by the loops and the turns. The empty space inside the spiral can be filled with filler rods such as 38 so as to reduce the permeability of the junction zone.

Figure 6:
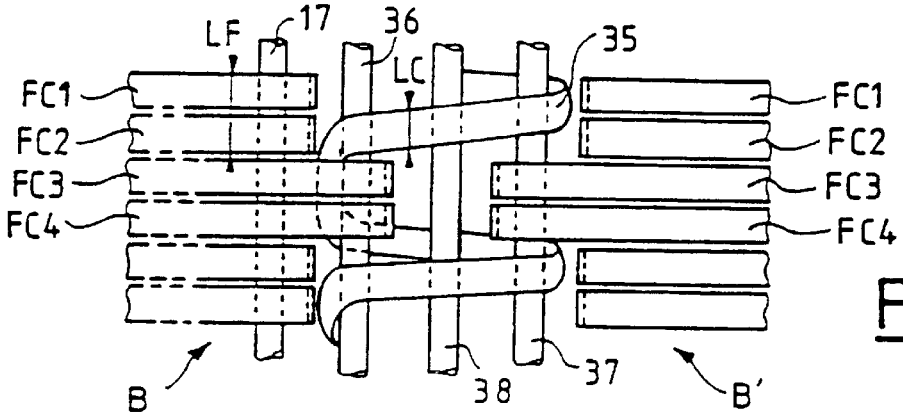

FIG. 6 shows a junction zone structure analogous to that of FIG. 5 except that the loops are grouped together in pairs and pairs of loops are spaced apart by pairs of empty spaces. In particular, this figure shows that the sequence of four consecutive warp yarns FC1–FC4 forms respectively: no loop, no loop, a loop, and another loop at the end Be of the strip. This configuration makes it possible to reduce the number of turns in the spiral 35 and to increase the width of the monofilament constituting each turn.

In embodiments of the kind shown in FIGS. 5 and 6, the turns of the spiral should have a width LS in the weft yarn direction that is less than 80% of the width LF of a warp yarn (FIG. 5) or of two warp yarns (FIG. 6). The strength of the junction is maximal and can be equal to that of the strip in the zones B. B' providing the spiral is of strength analogous to that of the strip. The advantage of using a spiral as shown in the embodiments of FIGS. 5 and 6 is that the two ends of the strip can be meshed with a junction of width that is smaller than that of the embodiment shown in FIG. 3, thereby contributing to reducing the risk of marking the sheet of paper.

Naturally, the above-described invention applies also to woven strips having two or more planes of weft yarns. The woven strip of the invention can advantageously be used in machines for making non-woven web material, e.g. diapers or nappies, paper towels, geotextiles, etc.

What is claimed is:

1. A woven strip (10) having an asymmetrical weave constituted by weft yarns (11–15, 17–24) and warp yarns (16) extending between two opposite ends of the strip, the warp yarns being folded back at each end of the strip and re-woven with weft yarns over a re-weaving zone (B, B') adjacent to said end so as to form loops (27), the outstrip being characterized in that each re-weaving zone having a symmetrical weave.

2. The strip of claim 1, in which said loops formed by the warp yarns (16) are folded orthogonally to the plane of the strip at each end thereof, and in that the weft yarns (17–24) in the re-weaving zones (B, B') are smaller in diameter than the weft yarns (11–15) in the remainder of the strip.

3. The strip of claim 2, comprising a single plane of weft yarns and in which the difference between the diameter of a weft yarn in the re-weaving zones and the diameter of a weft yarn in the remainder of the strip is equal to twice the thickness of a warp yarn.

4. The strip of claim 2, in which said loops formed by the warp yarns at each end of the strip form small loops and large loops, which large loops project relative to the small loops, and in which the small loops at a first end of the strip co-operate with the large loops at the other end of the strip to define a first channel in which a first rod (28) is received, and the large loops at the first end of the strip co-operate with the small loops at the other end of the strip to define a second channel in which a second rod (29) is received.

5. The strip of claim 2, in which said loops formed by the warp yarns at each end of the strip form small loops and large loops, which large loops project relative to the small loops, the small and large loops at one end of the strip being meshed with the turns of a first spiral (30) held by a first rod (31) received in a first channel formed by the small loops and by the turns, and by a second rod (32) received in a second channel formed by the large loops and the turns, the small and large loops at the other end of the strip being meshed with the turns of a second spiral (33) held by a third rod received in a third channel formed by the small loops and the turns, and by a fourth rod received in a fourth channel formed by the large loops and the turns, the turns of the first spiral (3) being meshed with the turns of the second spiral (33) and being held together by a fifth rod (34).

6. The strip of claim 2 in which said loops formed by the warp yarns at one end of the strip are re-woven at the other end of the strip so as to hold the turns of a spiral (35), and in which the turns of the spiral are meshed with these loops so as to define a channel in which a rod (37) is received.

7. The strip of claim 1, in which the warp yarns (16) are of flat section.

* * * * *